United States Patent [19]

Boggs

[11] Patent Number: 4,788,780

[45] Date of Patent: Dec. 6, 1988

[54] OVERBOOT

[76] Inventor: Ernest R. Boggs, 308 W. 7th, Leadville, Colo. 80461

[21] Appl. No.: 20,584

[22] Filed: Mar. 2, 1987

[51] Int. Cl.[4] ..... A43B 3/16; A43B 3/18; A43B 5/04

[52] U.S. Cl. ..... 36/7.1 R; 36/7.3; 36/58.5; 36/117

[58] Field of Search ..... 36/7.1 R, 7.1 A, 7.3, 36/4, 117, 585, 89, 122, 119

[56] References Cited

U.S. PATENT DOCUMENTS

| | | | |
|---|---|---|---|
| D. 139,007 | 10/1944 | Crotty . | |
| D. 204,975 | 6/1966 | Saraceni et al. . | |
| D. 247,591 | 3/1978 | Gwon . | |
| D. 269,137 | 5/1983 | Balbinot . | |
| 703,828 | 7/1902 | Read | 36/89 |
| 3,027,658 | 4/1962 | Rigsby . | |
| 3,895,452 | 7/1975 | Hanson et al. . | |
| 3,939,582 | 2/1976 | Garbuio . | |
| 4,136,468 | 1/1979 | Munschy . | |
| 4,258,481 | 3/1981 | Lamb . | |
| 4,461,098 | 7/1984 | Diegelman | 36/7.1 R |

FOREIGN PATENT DOCUMENTS

| | | | |
|---|---|---|---|
| 0167765 | 1/1986 | European Pat. Off. | 36/117 |
| 0185588 | 6/1986 | European Pat. Off. | 36/7.3 |
| 1007668 | 5/1957 | Fed. Rep. of Germany | 36/119 |
| 765616 | 3/1934 | France | 36/89 |
| 2236435 | 2/1975 | France | 36/7.1 R |
| 2437176 | 4/1980 | France | 36/117 |
| 2513095 | 3/1983 | France | 36/7.3 |
| 631632 | 8/1982 | Switzerland | 36/7.1 R |
| 767291 | 1/1957 | United Kingdom | 36/7.1 R |

OTHER PUBLICATIONS

*Backpacker* 12th issue, pp. 62 and 66, received PTO Feb. 25, 1986.

*Primary Examiner*—James Kee Chi
*Attorney, Agent, or Firm*—Dean P. Edmundson

[57] ABSTRACT

An overboot is described which is adapted to be worn over a conventional boot or shoe and which is further adapted to connect to a ski (e.g., a cross-country ski) or a showshoe. The overboot includes an elongated, generally flat sole member. Attached to the periphery of the sole member is a flexible, water-resistant upper member which extends upwardly from the sole. The upper member can be opened to allow a boot to be inserted; closure means is adapted to close the upper member around the boot. Strap means are used to urge the boot forwardly in the overboot and to secure the boot to the sole member. The overboot is adapted to fit more than one size of boot. A connection member projects forwardly of the upper member for detachably connecting the overboot to a ski or snowshoe. The sole member can be flexed between the forward and rearward ends.

24 Claims, 11 Drawing Sheets

OVERBOOT

FIELD OF THE INVENTION

This invention relates to footwear. More particularly, this invention relates to overboots. Even more particularly, this invention relates to overboots useful for cross-country skiing or snowshoeing.

BACKGROUND OF THE INVENTION

Cross-country skiing has become a popular winter activity. Although special shoes or boots are commercially available for use by the person skiing, such shoes or boots are designed and intended to be worn directly on the foot (i.e., not over another shoe or boot). Such shoes or boots are adapted to connect at the toe to the ski in a manner such that the heel may pivot upwardly while thettoe remains connected to the ski. In a similar manner shoes or boots worn with snowshoes are adapted to connect at the toe so that the heel may pivot upwardly.

However, there are times when people want to engage in cross county skiing or snowshoeing without having to purchase or rent the specialized boots. Also, the conventional ski boot does not keep the foot very warm in cold weather.

Shoe covers and expansible types of footwear are described in U.S. Pat. Nos. 3,027,658; Des. 204,975; 4,136,468; Des. 139,007; Des. 269,137; and Des. 247,591. However, none of such types of footwear are suitable as overboots for use in skiing or snowshoeing. Ski boots are described in U.S. Pat. Nos. 3,895,452; 3,939,582; and 4,258,481. The boots described in such patents, however, are intended to be worn directly on the foot of the user. They are for downhill skiing and are not suitable for cross-country skiing. Such boots are not intended or adapted to be worn over a shoe or boot.

SUMMARY OF THE PRESENT INVENTION

In accordance with the present invention there is provided an overboot which is adapted to be worn over a conventional shoe or boot and which is further adapted to connect to a ski (e.g., a cross-country ski) or snowshoe. The overboot is also adapted to fit more than one size of shoe or boot.

In one embodiment the overboot of the invention comprises:

(a) an elongated, dimensionally stable, generally flat sole member having a forward end and a rearward end, said forward end including a forwardly projecting connection member which is adapted to connect said overboot to a ski or snowshoe; where in the sole member is adapted to be flexed between the forward and rearward ends;

(b) a flexible, water-resistant upper member attached to the periphery of the sole member and extending upwardly therefrom; the upper member including toe and heel portions and further including vertical closure means; wherein the upper member is openable to allow the boot to be inserted therein, and the closure means is adapted to close the upper member around the boot.

In one embodiment there are further included adjustable heel strap means, ankle strap means, and toe strap means. The heel strap is adapted to extend around the heel portion of the boot and is adjustable to urge the boot or shoe forward within the overboot. The ankle strap and the toe strap secure the boot to the sole member within the overboot. The heel strap may be located on the inside or on the outside of the overboot.

In another embodiment an adjustable strap extends from the toe portion on one side of the sole member, then around the upper member, and then to the toe portion on the opposite side of the sole member to secure the boot to the sole member within the overboot.

In another embodiment there are two adjustable ankle straps. One ankle strap is secured at one of its ends adjacent the heel portion of the overboot, and the other ankle strap is secured at one of its ends adjacent the heel portion on the opposite side of the overboot. The straps then extend around the front of the upper member, then along opposite sides of the upper member to the back side of the upper member, and then they extend forwardly to a point forward of the point where their first ends are secured. This type of ankle strap system provides very firm support to the ankle and is desired when the user is involved in Telemark skiing.

Use of the overboot of this invention enables a person to engage in cross-country skiing without having to use conventional ski boots. Also, the overboot of this invention is adapted to be worn over more than one size of shoe or boot. Furthermore, the overboot keeps the foot warmer than a conventional ski boot. The overboot can also be used in conjunction with snowshoes.

Other advantages of the overboot of this invention will become apparent from the following description.

Brief Description of the Drawings

The invention is described in more detail hereinafter with reference to the accompanying drawings, wherein like reference characters refer to the same parts throughout the several views and in which.

DETAILED DESCRIPTION OF THE INVENTION

Figure 1:
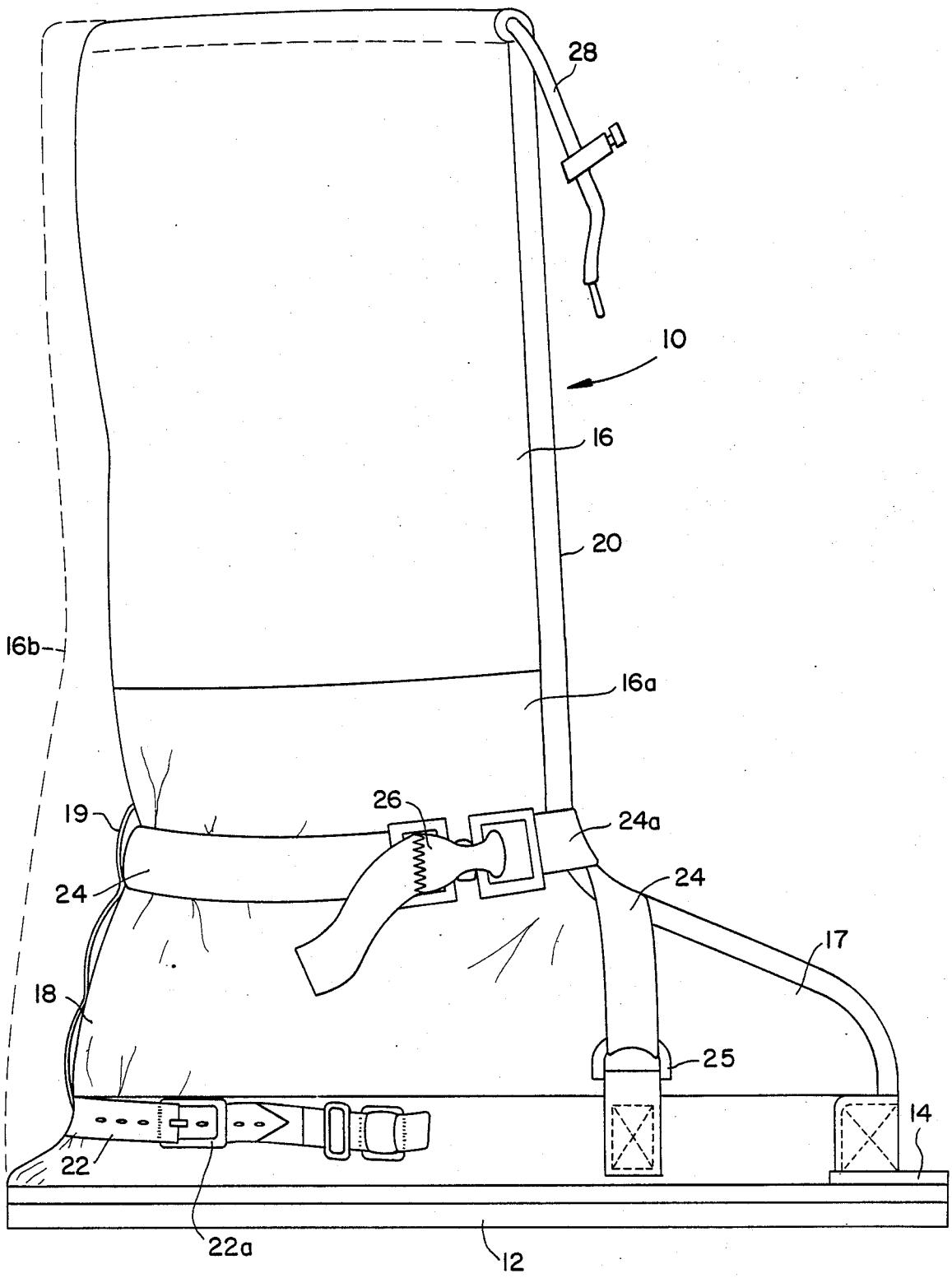
FIG. 1 is a side elevational view of one embodiment of overboot of this invention.

In FIG. 1 there is shown a side elevational view of one embodiment of overboot 10 of the invention. The overboot is suitable for wearing over a conventional shoe or boot and is adapted to be connected at the toe portion to a conventional cross-country ski or snowshoe. As used herein the reference to a conventional "boot" also is intended to include reference to a conventional shoe.

The overboot includes a sole member 12 having a forward end and a rearward end. The forward end includes a forwardly projecting connection member 14 which is adapted to connect the overboot to a conventional cross-country ski or snow shoe in a manner which is well known. For example, the connection member may have one or more vertical apertures therein which are adapted to slidably engage vertical pins carried on the top side of a conventional cross-country ski. The sole member is adapted to be flexed or bent between its forward and rearward ends. This enables the wearer to maneuver cross-country skis or snowshoes in the normal manner.

The overboot also includes a flexible, water-resistant upper member 16 which is attached to the periphery of the sole member and extends upwardly, as illustrated. The upper member includes a toe portion 17 and a heel portion 18. The upper member also includes vertical closure means 20, which preferably is located at the front of the upper member, and preferably it extends all the way from the toe portion to the top of the upper member 16. The closure means, when opened, allows the foot and boot of the wearer to be easily inserted into the overboot. Then the closure means can be closed again around the boot.

The lower portion **16*a* of the upper member 16** may be made of a flexible water-proof material such as rubber or water-proof plastic (e.g., nylon). The upper portion of the overboot may be made of flexible water-resistant material such as woven nylon cloth which is breathable.

Because the upper member is flexible, the overboot of this invention is adapted to fit several sizes of boots. After the boot has been inserted into the overboot, the adjustable heel strap 22 may be tightened, as illustrated, to urge the boot forward in the overboot and into the toe portion 17. Buckle **22*a* enables the heel strap 22** to be secured at the desired position.

Ankle strap means 24 is attached at one end to ring 25 near the toe portion of the overboot. The strap extends laterally over the toe portion and then extends horizontally along the opposite side of the upper member, passes through loop 19 at the back side of the upper member, and then extends forwardly along the upper member to buckle 26 where the strap 24 is secured. The buckle 26 is secured to strap **24*a*** which is secured to a ring member on the opposite side of the upper member. As illustrated, there may be a plurality of loops at the back of the upper member so that the ankle strap may be placed at any desired height relative to the sole member.

When strap 24 is tightened, as illustrated, the upper member is tightened around the ankle and toe of the wearer, the wearer's foot is secured to the sole member of the overboot. The strap 24 also pulls or collapses the upper member 16 around the boot.

Draw string 28 at the top of the upper member enables the top portion of the upper member to be drawn snugly around the leg of the wearer. The original position of the upper member is indicated by the dotted line **16*b***.

The sole member 12 is dimensionally stable and generally flat, as illustrated. The thickness of the sole member may vary (e.g., from about 0.25–1 inch). A preferred thickness is in the range of about 0.5–1 inch. The sole member may typically comprise leather or plastic which is water-resistant and sufficiently flexible to enable it to bend between its forward and rearward ends when it is worn over a boot and connected to a cross-country ski or snowshoe.

Figure 2:
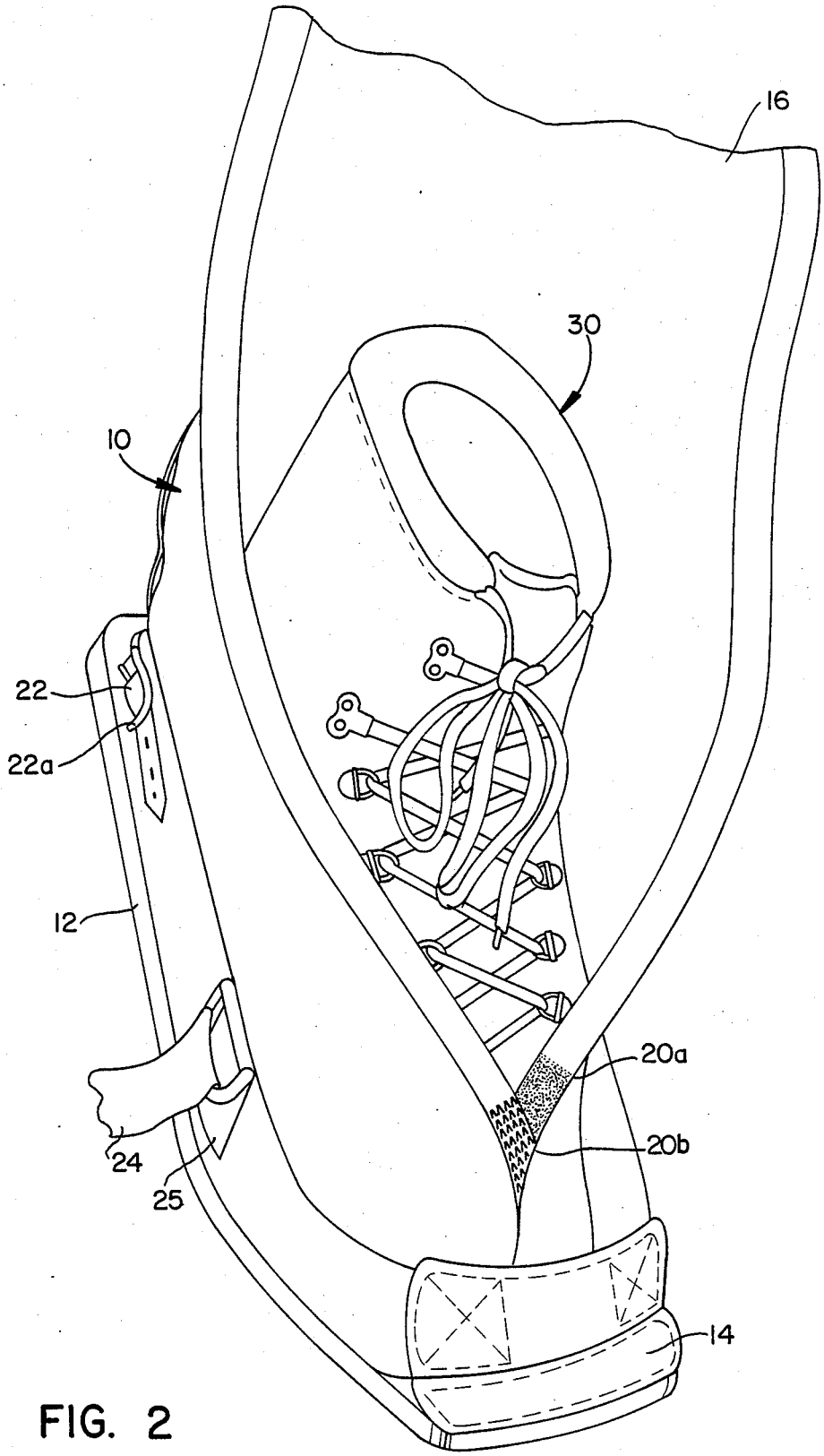
FIG. 2 is a front perspective view illustrating the manner in which a conventional shoe or boot is inserted into an overboot of the invention.

FIG. 2 illustrates a conventional boot or shoe 30 inserted into the overboot 10 of the invention. The closure means at the front of the overboot preferably comprises mating hook and loop fastener materials on the two flaps of the upper member. Thus, when flap **20*a* is aligned over and pressed against flap member 20*b*, as illustrated, the hook fastener on flap 20*b* engages the loop fastener material on flap 20*a* to releasably close the upper member around the boot 30**.

Figure 3:
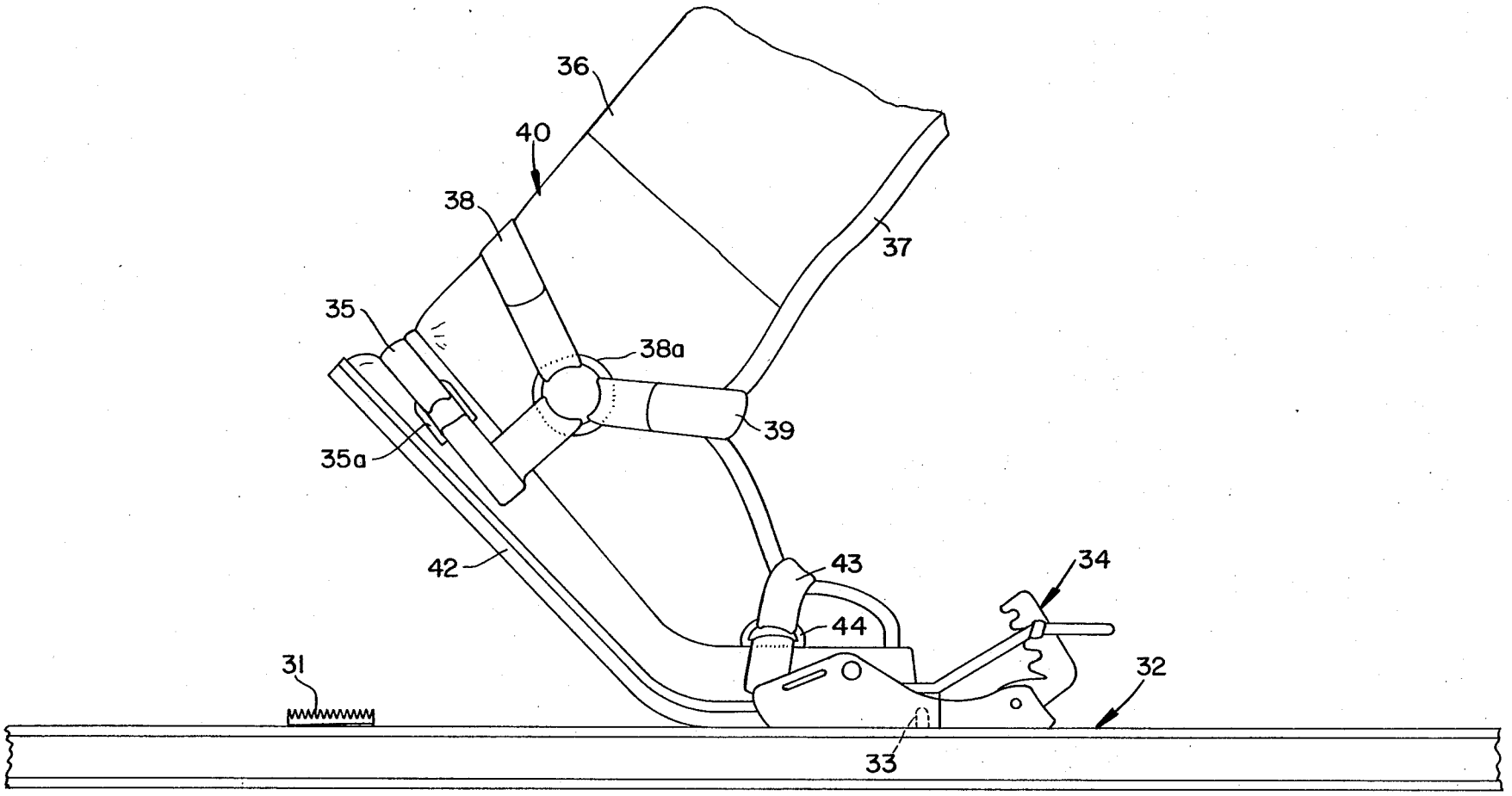
FIG. 3 is a side elevational view illustrating the use of the overboot for cross-country skiing.

FIG. 3 is a side elevational view illustrating an overboot 40 operably connected to a conventional cross-country ski 32 which includes an upwardly projecting peg or pin 33. The sole member 42 of overboot 40 includes one or more vertical apertures or openings at the leading end thereof which slidably engage one or more pins 33 on ski 32. Clamp member 34 holds the toe portion of the sole down onto a pin 33. Alignment block 31 on ski 32 assists in proper alignment of the overboot with the ski when the sole member is flat on the ski.

The overboot 40 includes a flexible water-resistant upper member 36 and closure means 37 which extends vertically up the front of the upper member. The closure means may be the hook and loop fastener material illustrated in FIG. 2, or it may be a conventional zipper, or it may be a series of snaps, or combinations of these types of closure means.

Heel strap 35 is secured at one end in ring **35*a*** and extends around the back side or heel portion of the upper member to a ring through which it is passed and then looped back upon itself. Hook and loop fastener material on the strap enables it to be detachably secured to itself. Alternatively, the strap may be secured to a buckle on the opposite side in a detachable manner.

Ankle strap 38 is secured at one end to ring member **38*a* and it extends around the back side of the ankle portion of the upper member to a ring through which it is passed and then folded back upon itself and secured (e.g., by means of a hook and loop fastener). Strap 39 is also attached to ring 38*a* and it extends around the front of upper 36** and through a ring on the opposite side. It is then folded back upon itself and secured (e.g., by means of hook and loop fastener).

Toe strap 43 is secured at one end to ring 44 on one side of the toe portion of the overboot. The opposite end of strap 43 maybe adjustably secured to a buckle or equivalent means on the opposite side of the toe portion. Alternatively, the trap may be passed through a ring on the opposite side and then folded back upon itself and secured by means of hook and loop fastener, for example.

Figure 4:
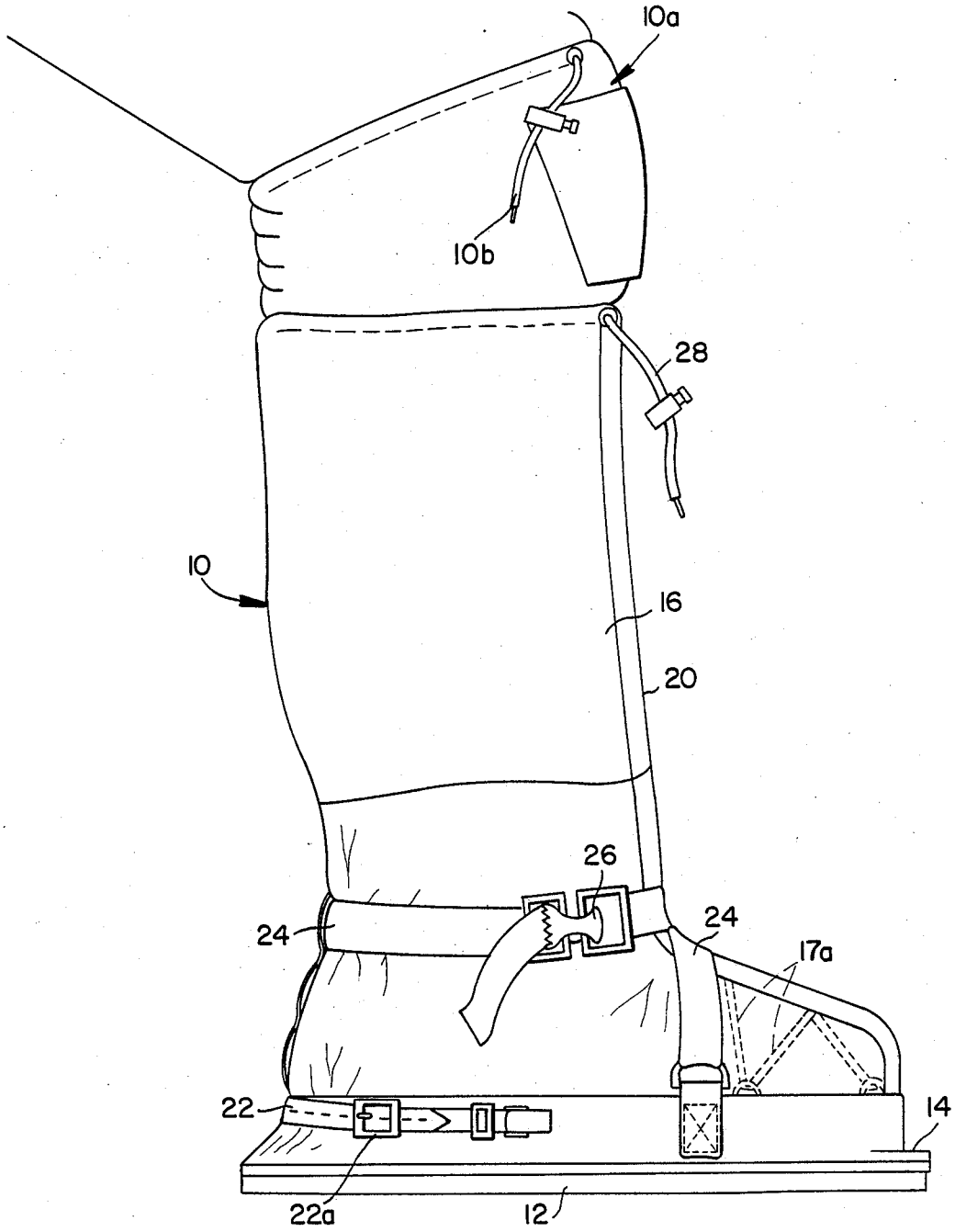
FIG. 4 is a side elevational view illustrating another embodiment of overboot of the invention.

FIG. 4 is a side elevational view illustrating a modification of overboot 10 shown in FIG. 1. In this embodiment there is further included a top section **10*a* which covers the knee of the wearer to keep it dry and warm. Draw string 10*b*** enables the top section to be drawn snug around the leg. The top section may be made of a flexible water-resistant material such as woven nylon.

FIG. 4 also illustrates lacing **17*a*** on the interior of the toe portion of the overboot. This lacing is used as an additional strap means to hold the toe of the boot to the sole of the overboot.

Figure 7:
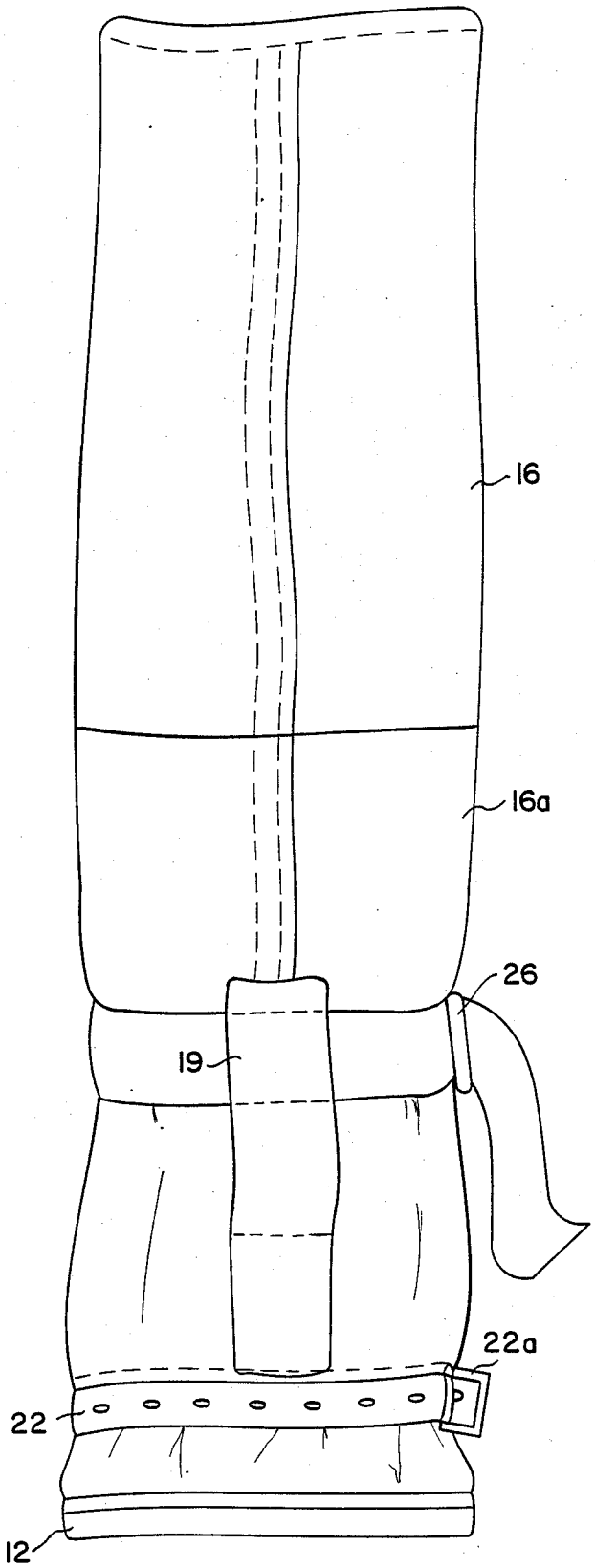
FIG. 7 is a rear elevational view of the overboot illustrated in FIG. 4.

A rear elevational view of the overboot of FIG. 4 is shown in FIG. 7.

Figure 5:
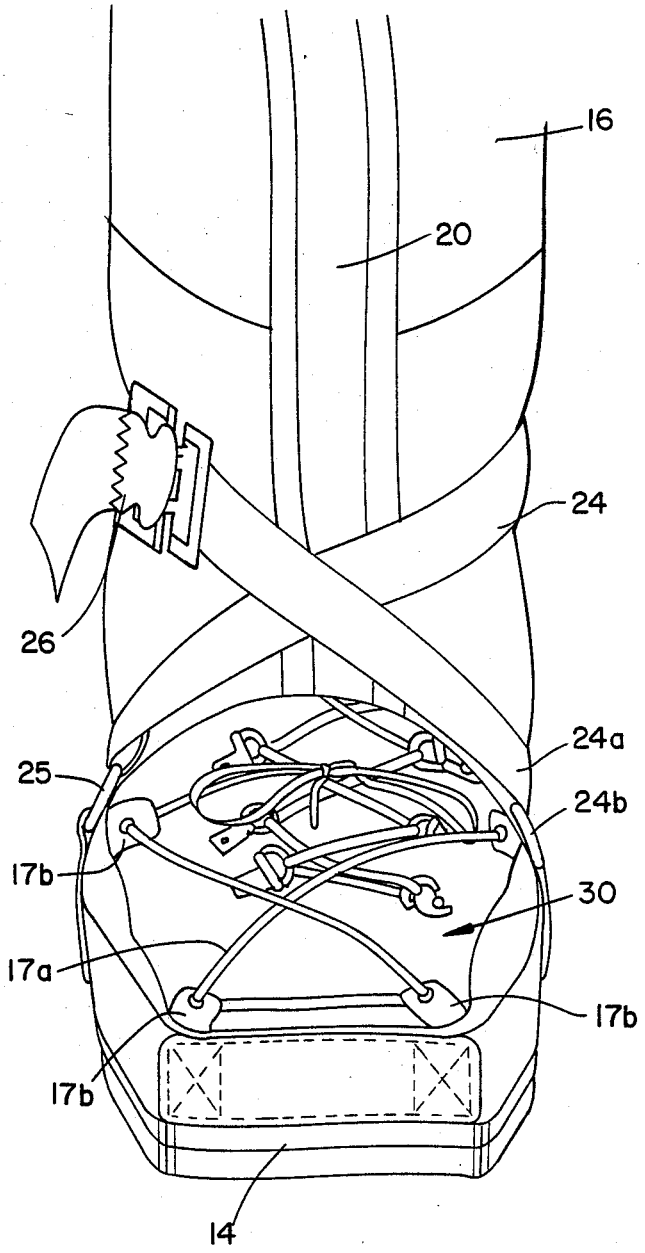
FIG. 5 is a front, partial cut-away view illustrating one type of toe strap which is useful in the overboot of the invention.

FIG. 5 is a front, partial cut-away view of the overboot 10 shown in FIG. 4. The toe portion of the upper member has been cut-away to reveal lacing 17*a* inside the overboot to hold the toe of boot 30 firmly down onto the sole member of the overboot. The eyelets 17*b* are secured to the inside the upper member. In this view strap 24*a* is shown secured at one end to ring 24*b* on one side of the upper member.

Figure 6:
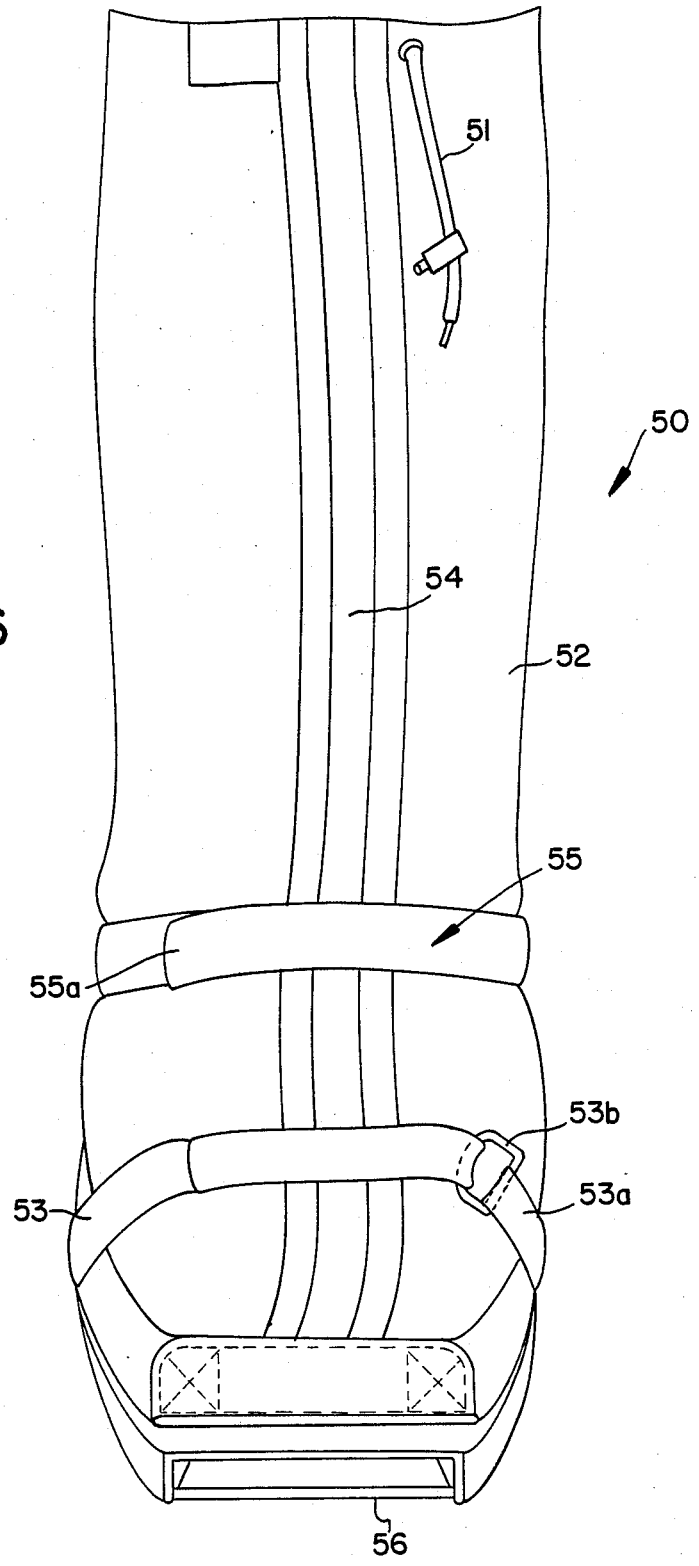
FIG. 6 is a front elevational view illustrating another type of toe strap which is useful in the overboot of the invention.

FIG. 6 is a front elevational view of another embodiment of overboot 50 having flexible upper member 52 and vertical closure member 54 extending along the front of the upper member. The closure means may be a hook and loop fastener, or a zipper, or a series of snaps, or combinations of these. Draw string 51 at the top of the upper member is for drawing the top snugly around the leg.

Strap 53 extends over the toe portion of the upper member, as illustrated. One end of strap 53 is secured to the upper and the other end is passed through ring 53*b* and then folded back upon itself where it is detachably secured by means of a hook and loop fastener. Ring 53*b* is attached to strap 53*a* which in turn is secured to the upper member.

Strap 55 is secured at one end to the upper member (near the sole). The other end 55*a* is passed through a ring on the opposite side of the upper member and is then folded back upon itself and secured with a hook and loop fastener.

The forward end of the sole member includes a horizontal bar 56, as illustrated, for facilitating connection of the overboot to a cross-country ski or snowshoe.

FIG. 8 is a front perspective view of another overboot 60 of the invention. In this embodiment the heel strap 62 is located in the interior of the overboot. Each end of the strap 62 is tied to an anchor 63, as illustrated. The anchors are secured to the sides of the upper member by stitching 61, for example. The connection between the strap 62 and anchor 63 is also illustrated in FIG. 8A.

The strap 62 may be elastic or inelastic. After the wearer has placed his or her boot into the overboot the strap can be tightened around the heel of the boot. This urges the boot forwardly and holds it into the toe portion of the overboot. Then the upper member may be closed around the overboot by connecting edges 64 and 65 together (e.g., by means of hook and loop fasteners carried by edges 64 and 65).

Figure 8D:
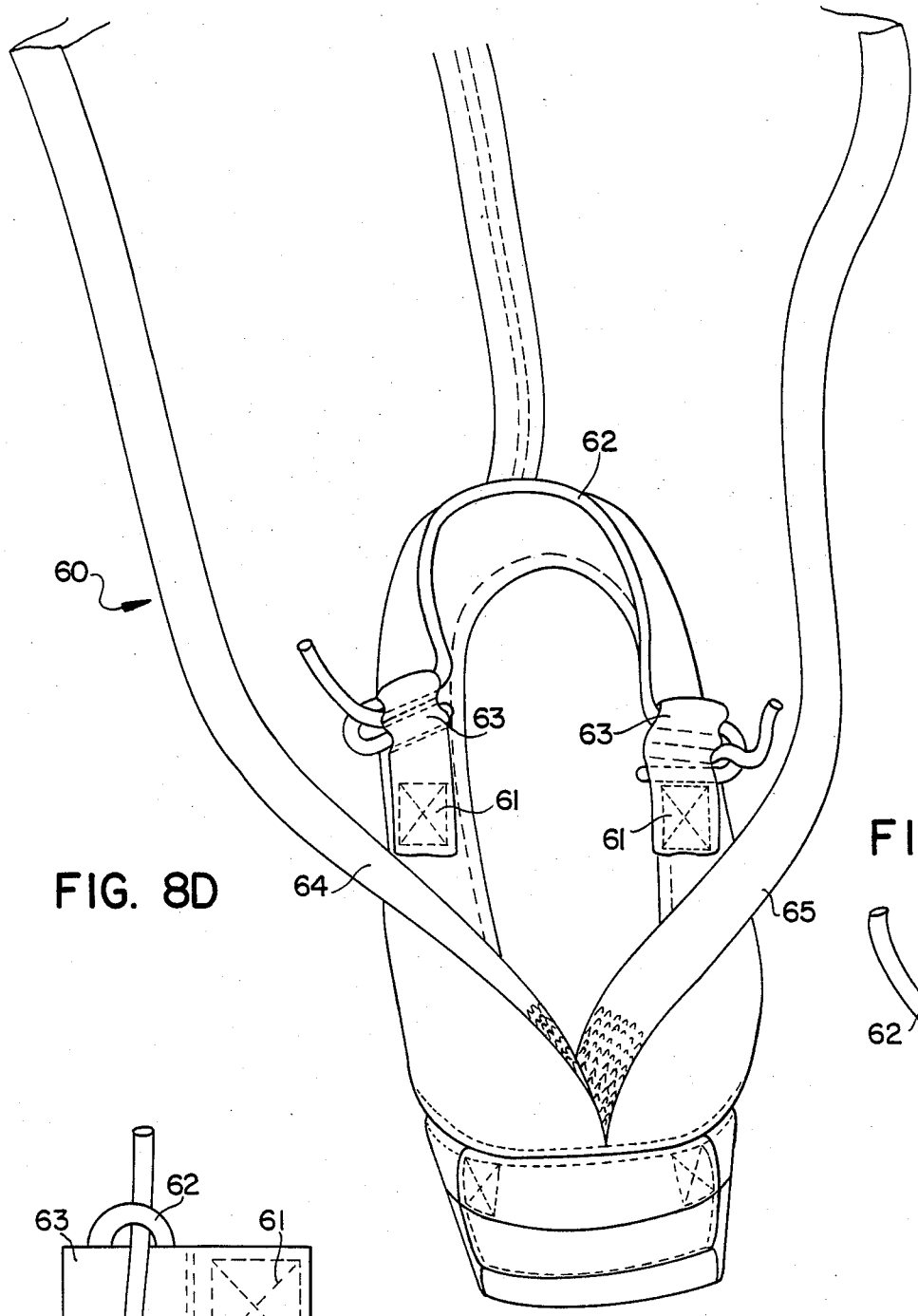
FIG. 8 is a front view illustrating another embodiment of overboot of the invention.
FIG. 8A illustrates one manner in which an interior heel strap may be tied or secured.
FIGS. 8B and 8C illustrate another manner in which an interior heel strap may be tied or secured.
Figure 8A:
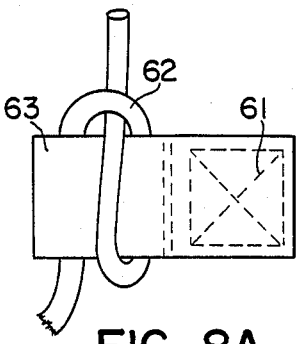
Figure 8B:
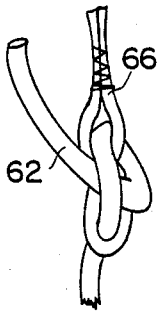
Figure 8C:
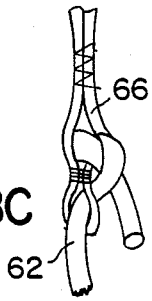

An alternative type of anchor 66 is illustrated in FIGS. 8B and 8C in which strap 62 is shown tied to the anchor 66. FIG. 8B is a top view of the knot and FIG. 8C is a bottom view of the knot.

Figure 9:
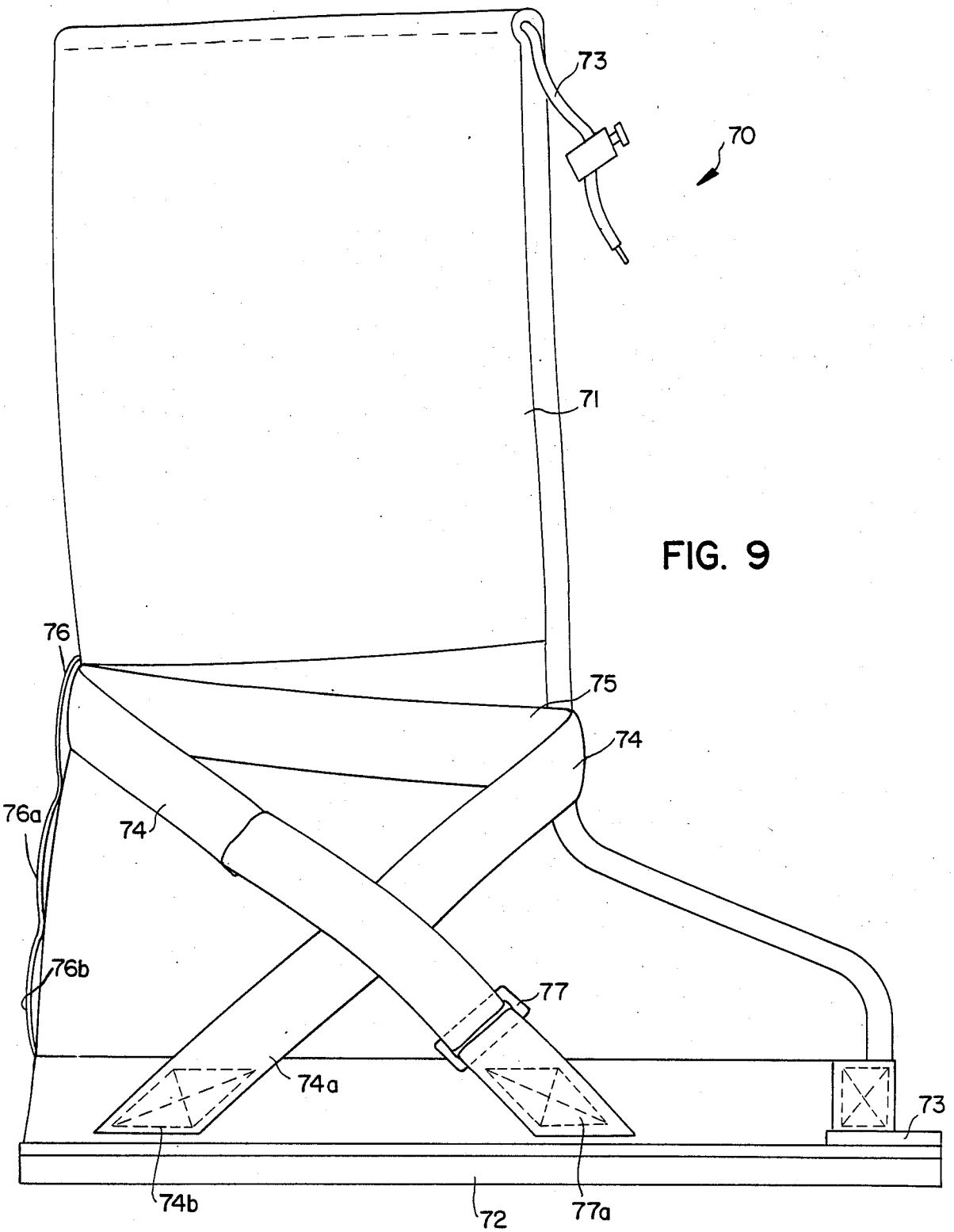
FIG. 9 is a side elevational view illustrating another embodiment of overboot of the invention.

FIG. 9 is a side elevational view of another embodiment of overboot 70 of the invention including upper member 71 and sole member 72. The front of the upper member is openable as illustrated in connection with the other embodiments of this invention. The forward end of the sole member includes a forwardly projecting connection member 73. Draw string 73 at the top of the upper member enables it to be drawn snugly around the leg.

In this embodiment there are two ankle strap member 74 and 75. One end 74*a* is secured to the base of the upper member 71 by means of stitching 74*b* at a position toward the rearward end of the overboot. The strap 74 extends around the front of the upper member, then rearwardly along the opposite side of the upper member, then through loop 76 on the back of the upper member and then through ring 77. The free end of strap 74 is folded back from itself, as illustrated, where it is detachably secured by means of a hook and loop fastener. Ring 77 is carried by strap 77*a* which is stitched or otherwise secured to the forward portion of the upper member.

In a similar fashion strap 75 is secured at one end to the rear portion of the upper member on the opposite side, then it extends around the front of the upper member, then rearwardly along the side (as shown), then through the loop 76, and finally it is passed through a ring similar to ring 77 and folded back upon itself and detachably secured.

The other loop members 76*a* and 76*b* at the rear of the overboot enable the straps 74 and 75 to be placed at any desired height relative to the sole member 72.

Figure 10:
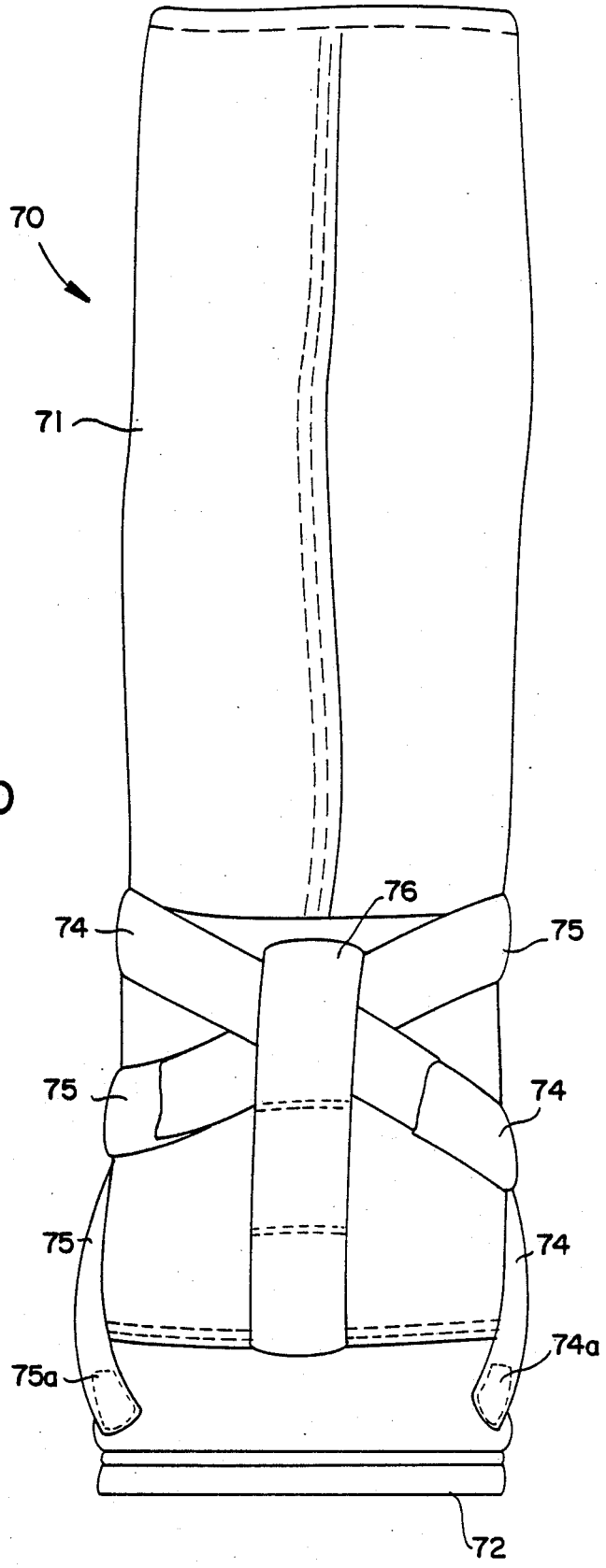
FIG. 10 is a rear elevational view of the overboot shown in FIG. 9.
Figure 11:
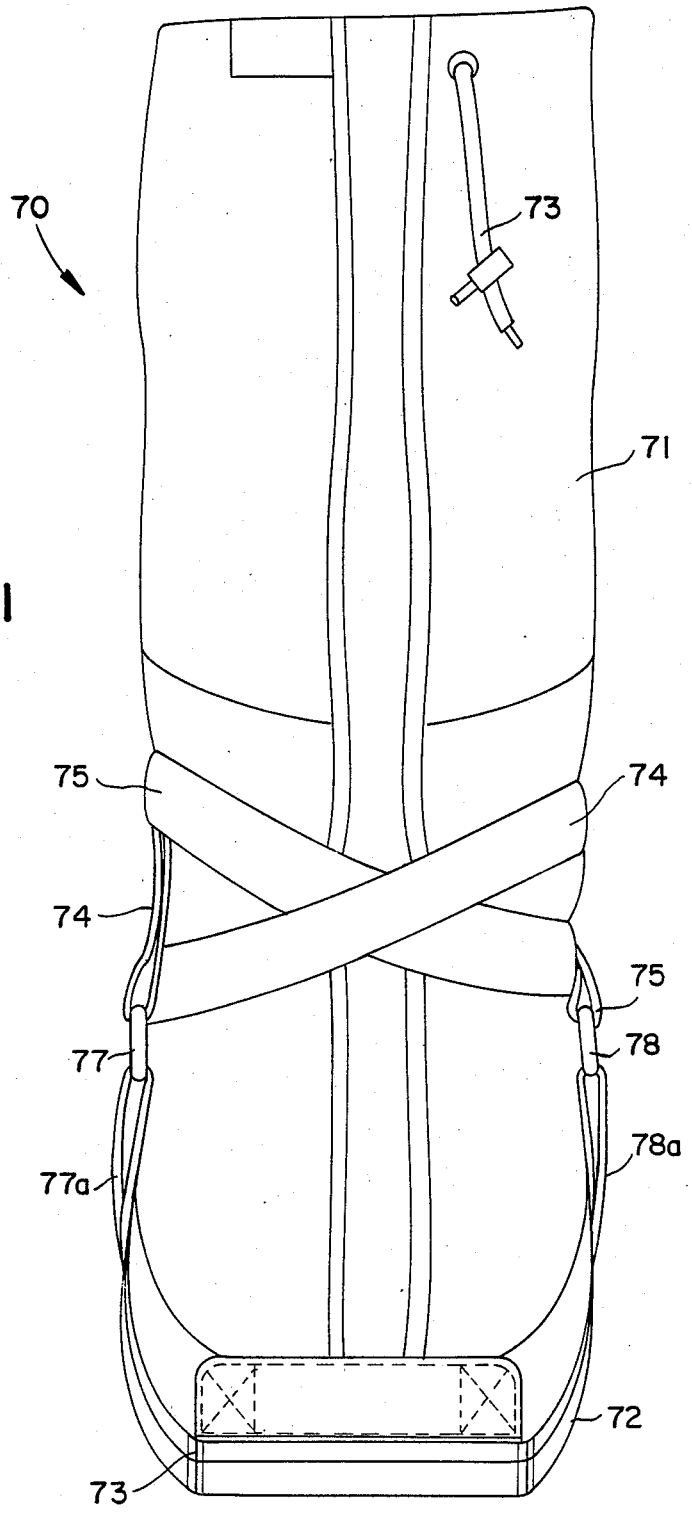
FIG. 11 is a front elevational view of the overboot shown in FIG. 9.

FIG. 10 is a rear view of the embodiment of FIG. 9. FIG. 11 is a front view of the embodiment of FIG. 9. In FIG. 10 it is possible to see the end 75*a* of strap 75 secured to the rearward portion of upper member 71. In FIG. 11 it is possible to see ring 78 through which strap 75 is looped and then detachably secured to itself, e.g., with hook and loop fastener. Ring 78 is attached to strap 78*a*, as illustrated.

The type of ankle straps shown in FIGS. 9–11 is particularly useful for overboot used in Telemark skiing or mountaineer skiing where greater ankle support is desired.

The overboots of the invention are light and may be rolled into a compact bundle for storage or for carrying purposes. They also provide additional warmth to the foot and the lower leg when they are used as described. Additional insulation may be placed within the upper member, if desired, for additional warmth.

Because of the manner in which the overboot can be tightened around a conventional boot or shoe, the overboot can accommodate boots and shoes of various sizes.

The height of the upper member may vary, for example, from about 6 inches to about 26 inches or more. As illustrated in FIG. 4, the upper member may even extend over the knee, if desired.

Other variations are possible without departing from the scope of the present invention. For example, the closure means may be located at the back edge instead of the front edge of the upper member. It is also possible to include additional straps, if desired, to hold the toe, heel or the ankle.

What is claimed is:

1. An overboot adapted to be worn over a conventional boot or shoe and being further adapted to connect to a cross-country ski or to a snowshoe, said overboot comprising:

(a) an elongated, dimensionally stable, generally flat sole member having a forward end and a rearward end, said forward end including a forwardly projecting connection member which is adapted to connect said overboot to said ski or snowshoe; wherein said sole member is adapted to be flexed between said forward and rearward ends;

(b) a flexible, water-resistant upper member attached to the periphery of said sole member and extending upwardly therefrom, said upper member including toe and heel portions and further including vertical closure means; wherein said upper member is openable to allow said boot to be inserted therein, and said closure means being adapted to close said upper member around said boot;

(c) horizontal, adjustable heel strap means carried by said upper member and extending from one side of said upper member to the opposite side thereof around said heel portion, said heel strap means being adapted to urge said boot forward in said overboot; wherein said heel strap means is adapted to collapse said heel portion of said upper member rearwardly of said boot in a manner such that said heel strap means retains said boot in a forward position in said overboot;

(d) ankle strap means carried by said upper member and being adapted to tighten said upper member around said boot; and (e) adjustable toe strap means adapted to extend over said toe portion of said upper member and being further adapted to be tightened over the toe of said boot;

wherein said heel strap means, ankle strap means, and toe strap means are adapted to secure said boot to said sole member within said overboot.

2. An overboot in accordance with claim 1, wherein said sole member is planar and comprises leather.

3. An overboot in accordance with claim 1, wherein said upper member comprises nylon.

4. An overboot in accordance with claim 1, wherein said closure means extends vertically from said toe portion of said upper member to the top of said upper member.

5. An overboot in accordance with claim 1, wherein said connection member comprises a tongue projecting forwardly of said toe portion of said upper member.

6. An overboot in accordance with claim 1, wherein said closure means comprises a hook and loop fastener.

7. An overboot in accordance with claim 1, wherein said upper member includes a plurality of vertically-spaced loop members on said heel portion thereof, wherein said ankle strap means is adapted to engage one of said loop members.

8. An overboot in accordance with claim I, wherein said upper member comprises a lower portion of water-impermeable material.

9. An overboot adapted to be worn over a conventional boot or shoe and being further adapted to connect to a cross-country ski or to a snowshoe, said overboot comprising:

(a) an elongated, dimensionally stable, generally flat sole member having a forward end and a rearward end, said forward end including a forwardly projecting connection member which is adapted to connect said overboot to said ski or snowshoe; wherein said sole member is adapted to be flexed between said forward and rearward ends;

(b) a flexible, water-resistant upper member attached to the periphery of said sole member and extending upwardly therefrom, said upper member including toe and heel portions and further including vertical closure means; wherein said upper member is openable to allow said boot to be inserted therein, and said closure means being adapted to close said upper member around said boot;

(c) adjustable heel strap means adapted to extend around the back side of said boot; wherein said heel strap means is adapted to collapse said heel portion of said upper member rearwardly of said boot in a manner such that said heel strap means retains said boot in a forward position in said overboot;

wherein said heel strap means is adapted to urge said boot forwardly in said overboot and is further adapted to secure said boot to said sole member within said overboot.

10. An overboot in accordance with claim 9, wherein said sole member is planar and comprises leather.

11. An overboot in accordance with claim 9, wherein said upper member comprises nylon.

12. An overboot in accordance with claim 9, wherein said closure means extends vertically from said toe portion of said upper member to the top of said upper member.

13. An overboot in accordance with claim 9, wherein said heel strap means is elastic.

14. An overboot in accordance with claim 9, wherein said connection member comprises a tongue projecting forwardly of said toe portion of said upper member.

15. An overboot in accordance with claim 9, wherein said closure means comprises a hook and loop fastener.

16. An overboot in accordance with claim 9, wherein said upper member comprises a lower portion of water-impermeable material.

17. An overboot in accordance with claim 9, wherein said heel strap means is secured to said sole member and is disposed within said overboot.

18. An overboot in accordance with claim 9, wherein said heel strap means is attached to and carried by said upper member.

19. An overboot in accordance with claim 9, further comprising adjustable toe strap means adapted to extend over said toe portion of said upper member and being further adapted to be tightened over the toe of said boot.

20. An overboot in accordance with claim 9, further comprising adjustable strap securement means adapted to extend from said toe portion on one side of said sole member, around said upper member, and to said toe portion on the opposite side of said sole member.

21. An overboot in accordance with claim 9, further comprising two adjustable ankle straps wherein said strap members are adapted to extend completely around said upper member from opposite sides thereof.

22. A combination comprising:

(a) a boot;

(b) a ski; and (c) an overboot adapted to be worn over said boot and being further adapted to connect to said ski; said overboot comprising:

(i) an elongated dimensionally stable, generally flat sole member having a forward end and a rearward end, said forward end including a forwardly projecting connection member which is adapted to connect said overboot to said ski; wherein said sole member is adapted to be flexed between said forward and rearward ends;

(ii) a flexible, water-resistant upper member attached to the periphery of said sole member and extending upwardly therefrom, said upper member including toe and heel portions and further including vertical closure means; wherein said upper member is openable to allow said boot to be inserted therein, and said closure means being adapted to close said upper member around said boot;

(iii) adjustable heel strap means adapted to extend around the back side of said boot; said heel strap means being adapted to urge said boot forward in said overboot; wherein said heel strap means is adapted to collapse said heel portion of said upper member rearwardly of said boot in a manner such that said heel strap means retains said boot in a forward position in said overboot; and (iv) adjustable toe strap means adapted to extend over said toe portion of said upper member and being further adapted to be tightened over the toe of said boot;

wherein said heel strap means and toe strap means are adapted to secure said boot to said sole member within said overboot; wherein said connection member of said overboot is detachably connected to said ski.

23. A combination in accordance with claim 22, wherein said overboot further comprises ankle strap means carried by said upper member and being adapted to tighten said upper member around said boot.

24. An overboot adapted to be worn over a conventional boot or shoe and being further adapted to connect to a cross-country ski or to a snowshoe, said overboot comprising:

(a) an elongated, dimensionally stable, generally flat sole member having a forward end and a rearward end, said forward end including a forwardly projecting connection member which is adapted to connect said overboot to said ski or snowshoe; wherein said sole member is adapted to be flexed between said forward and rearward ends;

(b) a flexible, water-resistant upper member attached to the periphery of said sole member and extending upwardly therefrom, said upper member including toe and heel portions and further including vertical closure means; wherein said upper member is openable to allow said boot to be inserted therein, and said closure means being adapted to close said upper member around said boot;

(c) horizontal, adjustable heel strap means adapted to extend around the back side of said boot; wherein said heel strap means is located within said overboot and is carried by said upper member; wherein said heel strap means is adapted to urge said boot forward in said overboot and retain said boot in a forward position in said overboot;

(d) ankle strap means carried by said upper member and being adapted to tighten said upper member around said boot;

wherein said heel strap means and said ankle strap means are adapted to secure said boot to said sole member within said overboot.

* * * * *